US006057045A

United States Patent [19]

Wojcieszynski et al.

[11] Patent Number: 6,057,045

[45] Date of Patent: May 2, 2000

[54] HIGH-SPEED STEEL ARTICLE

[75] Inventors: Andrzej L. Wojcieszynski, Pittsburgh; William Stasko, West Homestead, both of Pa.

[73] Assignee: Crucible Materials Corporation, Syracuse, N.Y.

[21] Appl. No.: 08/949,497

[22] Filed: Oct. 14, 1997

[51] Int. Cl.[7] ..... C22C 29/02; C22C 38/00

[52] U.S. Cl. ..... 428/546; 75/236; 75/246; 148/324; 148/334; 148/442; 420/10; 420/15; 420/27; 420/107; 420/110; 420/111; 420/114; 420/583; 420/588

[58] Field of Search ..... 75/238, 236, 239, 75/240, 245, 246; 428/637, 656, 678, 681, 457, 546; 420/10, 15, 27, 107, 110, 111, 114, 122, 124, 127, 583, 588; 148/311, 324, 334, 442

[56] References Cited

U.S. PATENT DOCUMENTS

| | | |
|---|---|---|
| 2,147,121 | 2/1939 | Emmons . |
| 2,174,286 | 9/1939 | Gill . |
| 2,239,058 | 4/1941 | Schlumpf . |
| 3,591,349 | 7/1971 | Benjamin . |
| 3,850,621 | 11/1974 | Haberling et al. . |
| 4,032,302 | 6/1977 | Nakamura et al. . |
| 4,249,945 | 2/1981 | Haswell et al. . |
| 4,469,514 | 9/1984 | Holtz, Jr. . |
| 4,519,839 | 5/1985 | Toyoaki et al. . |
| 4,576,642 | 3/1986 | Holtz, Jr. . |
| 4,863,515 | 9/1989 | Roberts et al. . |
| 4,880,461 | 11/1989 | Uchida ..... 75/238 |
| 5,021,085 | 6/1991 | Karagoz et al. . |
| 5,252,119 | 10/1993 | Nishida et al. . |
| 5,403,372 | 4/1995 | Uchida . |
| 5,435,827 | 7/1995 | Wisell . |
| 5,525,140 | 6/1996 | Wisell . |
| 5,578,773 | 11/1996 | Wisell . |

FOREIGN PATENT DOCUMENTS

| | | |
|---|---|---|
| 0 377 307 | 7/1990 | European Pat. Off. . |
| 85-193766/32 | 12/1983 | Japan . |
| 7-179945 | 7/1995 | Japan . |
| WO 93/02819 | 2/1993 | WIPO . |
| WO 93/02820 | 2/1993 | WIPO . |

*Primary Examiner*—Deborah Jones
*Assistant Examiner*—Robert R. Koehler
*Attorney, Agent, or Firm*—Finnegan, Henderson, Farabow, Garrett & Dunner, L.L.P.

[57] ABSTRACT

A powder-metallurgy produced high-speed steel article having a combination of high hardness and wear resistance, particularly at elevated temperatures. This combination of properties is achieved by the combination of W, Mo, V, and Co. The article is particularly suitable for use in the manufacture of gear cutting tools, such as hobs, and surface coatings.

15 Claims, 2 Drawing Sheets

Comparison of the tempering response of CPM Rex 25, CPM Rex 76 and new high speed steels.

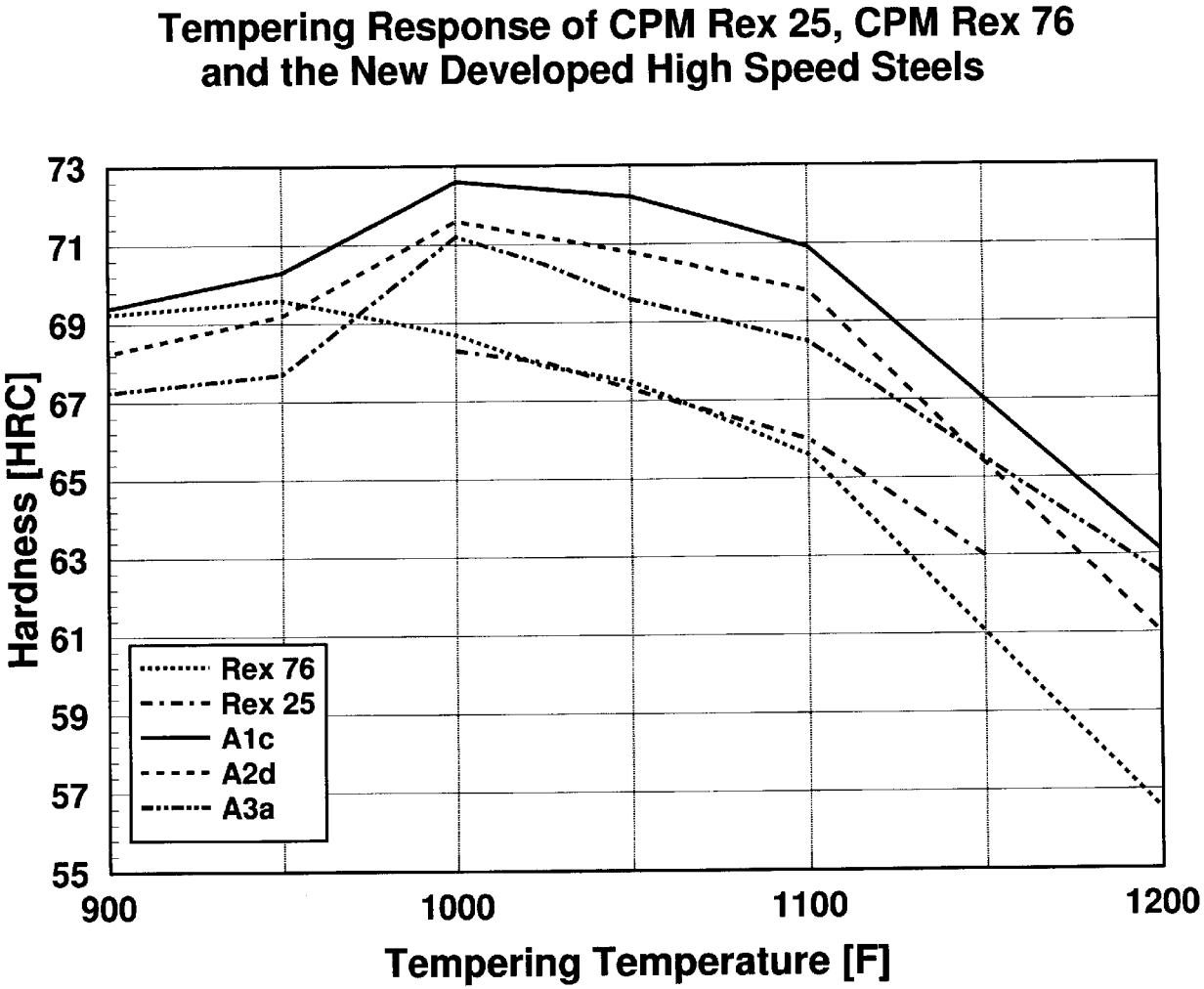
Figure 1. Comparison of the tempering response of CPM Rex 25, CPM Rex 76 and new high speed steels.

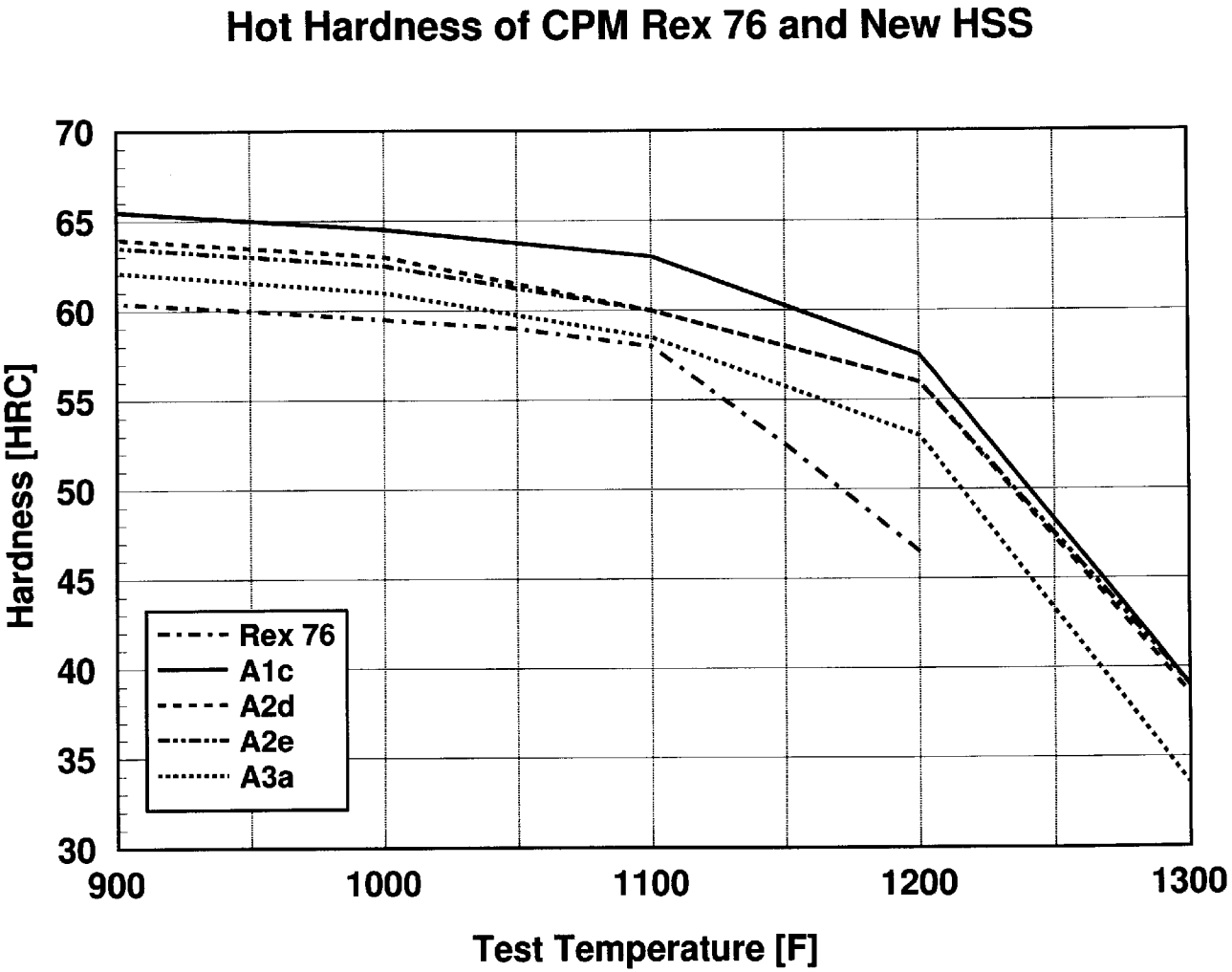
Figure 2. Comparison of hot hardness of CPM Rex 76 and several new high speed steels made to the chemistries A1, A2 and A3.

HIGH-SPEED STEEL ARTICLE

BACKGROUND OF THE INVENTION

The invention relates to a powder-metallurgy produced high-speed steel article characterized by high hardness and wear resistance, particularly at elevated temperatures, suitable for use in the manufacture of gear cutting tools, such as hobs and other tooling applications requiring very high wear resistance.

In tooling applications requiring high hardness and wear resistance where the tool during use is subjected to elevated temperatures exceeding about 1000° F. and up to for example 1200° F., it is typical to employ carbide material for the manufacture of these tools. Carbide material, however, has the significant disadvantage of being difficult to machine to the desired tooling configurations, particularly intricate cutting surfaces, and is characterized by relatively poor toughness, which renders the tool made therefrom susceptible to cracking and chipping during use. In these applications, it is desirable to employ high speed steels, rather than carbide materials, because high speed steels are easier to machine to the desired tooling configuration and exhibit much higher toughness than carbide materials. High speed steels have not been used in these applications, however, because they do not exhibit the necessary hardness, and thus wear resistance, at the elevated temperatures in which conventional carbide tools are employed.

It is accordingly an object of the present invention to provide a powder metallurgy produced high-speed steel article useful for the production of gear cutting tools, such as hobs and other tooling applications requiring high wear resistance. The material shall be capable of attaining and maintaining high hardness at the elevated temperatures anticipated in carbide cutting tool applications and yet have the benefit of high-speed steels from the standpoint of toughness and machinability.

SUMMARY OF THE INVENTION

The invention relates generally to a powder metallurgy produced high-speed steel article of compacted high-speed steel powder particles. The steel consists essentially of, in weight percent, 2.4 to 3.9 carbon, up to 0.8 manganese, up to 0.8 silicon, 3.75 to 4.75 chromium, 9.0 to 11.5 tungsten, 4.75 to 10.75 molybdenum, 4.0 to 10.0 vanadium, and 8.5 to 16.0 cobalt, with 2.0 to 4.0 niobium being selectively present, and the balance iron and incidental impurities.

The following are preferred and more preferred high-speed steel compositions, in weight percent, in accordance with the invention:

The article in accordance with the invention may have a minimum hardness of 70 $R_c$ in the as-quenched and tempered condition and preferably a minimum hardness of 61 $R_c$ after tempering at 1200° F. Preferably, the minimum hardness in the as-quenched and tempered condition may be 72 $R_c$. Preferably, the hardness after tempering at 1200° F. may be 63 $R_c$.

The article in accordance with the invention may be in the form a gear cutting tool, such as a hob, or a surface coating on a substrate.

BRIEF DESCRIPTION OF THE DRAWINGS

FIG. 1 is a graph showing the tempering response of alloys in accordance with the invention compared to conventional powder-metallurgy produced alloys; and FIG. 2 is a graph showing the hot hardness of alloys in accordance with the invention compared to conventional powder-metallurgy produced alloys.

DESCRIPTION OF THE PREFERRED EMBODIMENTS

By way of demonstration of the invention, powder metallurgy produced articles for testing were produced with the alloy compositions, in weight percent, set forth in Table 1.

| | Alloy No. 1 | | Alloy No. 2 | | Alloy No. 3 | |
|---|---|---|---|---|---|---|
| Composition | Preferred | More Preferred | Preferred | More Preferred | Preferred | More Preferred |
| C | 2.60–3.50 | 3.00–3.30 | 2.40–3.20 | 2.90–3.10 | 2.90–3.90 | 3.20–3.60 |
| Mn | Max. 0.8 | Max. 0.5 | Max. 0.8 | Max. 0.5 | Max. 0.8 | Max. 0.5 |
| Si | Max. 0.8 | Max. 0.5 | Max. 0.8 | Max. 0.5 | Max. 0.8 | Max. 0.5 |
| Cr | 3.75–4.75 | 4.2–4.6 | 3.75–4.50 | 3.90–4.20 | 3.75–4.50 | 3.90–4.20 |
| W | 9.0–11.5 | 10.5–11 | 9.75–10.75 | 10–10.5 | 9.50–11.00 | 10.00–10.50 |
| Mo | 9.50–10.75 | 10.00–10.50 | 6.75–8.25 | 7.25–7.75 | 4.75–6.00 | 5.00–5.50 |
| V | 4.0–6.0 | 5–5.5 | 5.0–7.0 | 6–6.5 | 8.50–10.00 | 9.00–9.50 |
| Nb | 2.0–4.0 | 2.8–3.2 | — | — | — | — |
| Co | 14.00–16.00 | 14.50–15.00 | 13.00–15.00 | 14–14.5 | 8.50–10.00 | 9.00–9.50 |

TABLE 1

| Alloy | C | Mn | Si | Cr | W | Mo | V | Nb | Co | Ti | Al | P | S | O | N |
|---|---|---|---|---|---|---|---|---|---|---|---|---|---|---|---|
| Rex 76 | 1.52 | 0.32 | 0.32 | 3.79 | 9.72 | 5.31 | 3.14 | — | 8.22 | — | — | 0.015 | 0.059 | 0.009 | 0.031 |
| Rex 25 | 1.78 | 0.33 | 0.43 | 3.93 | 12.6 | 6.52 | 5.1 | 0.02 | 0.34 | 0.004 | — | 0.017 | 0.062 | — | 0.046 |
| M25a | 1.93 | 0.33 | 0.43 | 3.94 | 12.6 | 6.52 | 5.1 | 0.02 | 0.34 | 0.004 | — | 0.017 | 0.062 | — | 0.046 |
| M25b | 2.03 | 0.33 | 0.43 | 3.94 | 12.6 | 6.52 | 5.1 | 0.02 | 0.34 | 0.004 | — | 0.017 | 0.062 | — | 0.046 |
| M2511a | 1.89 | 0.26 | 0.76 | 4.2 | 11.91 | 10.95 | 5.01 | — | — | — | — | — | — | 0.005 | 0.03 |
| M2511b | 2.19 | 0.26 | 0.76 | 4.2 | 11.91 | 10.95 | 5.01 | — | — | — | — | — | — | 0.005 | 0.03 |
| M2511c | 2.34 | 0.26 | 0.76 | 4.2 | 11.91 | 10.95 | 5.01 | — | — | — | — | — | — | 0.005 | 0.03 |
| M2511d | 2.44 | 0.26 | 0.76 | 4.2 | 11.91 | 10.95 | 5.01 | — | — | — | — | — | — | 0.005 | 0.03 |
| M766a | 2.23 | 0.47 | 0.38 | 3.88 | 10.01 | 5.1 | 6.07 | — | 9.11 | — | — | 0.01 | 0.006 | 0.029 | 0.05 |
| M766b | 2.33 | 0.47 | 0.38 | 3.88 | 10.01 | 5.1 | 6.07 | — | 9.11 | — | — | 0.01 | 0.006 | 0.029 | 0.05 |
| M766c | 2.53 | 0.47 | 0.38 | 3.88 | 10.01 | 5.1 | 6.07 | — | 9.11 | — | — | 0.01 | 0.006 | 0.029 | 0.05 |
| M769a | 2.97 | 0.47 | 0.35 | 3.94 | 10.19 | 5.2 | 9.12 | — | 9.17 | — | — | 0.01 | 0.005 | 0.011 | 0.039 |
| M769b | 3.12 | 0.47 | 0.35 | 3.94 | 10.19 | 5.2 | 9.12 | — | 9.17 | — | — | 0.01 | 0.005 | 0.011 | 0.039 |
| E1a | 2.24 | 0.42 | 0.50 | 3.96 | 12.15 | 6.75 | 5.04 | 2.59 | 5.99 | — | — | 0.01 | 0.004 | 0.009 | 0.041 |
| E1b | 2.39 | 0.42 | 0.50 | 3.96 | 12.15 | 6.75 | 5.04 | 2.59 | 5.99 | — | — | 0.01 | 0.004 | 0.009 | 0.041 |
| E2a | 1.80 | 0.42 | 0.51 | 4.04 | 6.11 | 9.86 | 3.07 | 1.97 | 11.96 | — | 0.52 | 0.01 | 0.006 | 0.009 | 0.021 |
| E2b | 1.95 | 0.42 | 0.51 | 4.04 | 6.11 | 9.86 | 3.07 | 1.97 | 11.96 | — | 0.52 | 0.01 | 0.006 | 0.009 | 0.021 |
| E3a | 2.19 | 0.42 | 0.51 | 3.98 | 4.96 | 10.10 | 4.90 | 2.53 | 7.83 | — | — | 0.01 | 0.005 | 0.008 | 0.042 |
| E3b | 2.34 | 0.42 | 0.51 | 3.98 | 4.96 | 10.10 | 4.90 | 2.53 | 7.83 | — | — | 0.01 | 0.005 | 0.008 | 0.042 |
| E4a | 2.34 | 0.42 | 0.50 | 4.00 | 5.00 | 10.22 | 4.01 | 2.45 | 7.85 | 0.51 | 0.71 | 0.01 | 0.005 | 0.009 | 0.044 |
| E4b | 2.39 | 0.42 | 0.50 | 4.00 | 5.00 | 10.22 | 4.01 | 2.45 | 7.85 | 0.51 | 0.71 | 0.01 | 0.005 | 0.009 | 0.044 |
| E6a | 3.04 | 0.58 | 0.67 | 4.00 | 10.04 | 6.00 | 9.98 | — | 17.81 | — | — | 0.01 | 0.011 | 0.01 | 0.035 |
| E6b | 3.54 | 0.58 | 0.67 | 4.00 | 10.04 | 6.00 | 9.98 | — | 17.81 | — | — | 0.01 | 0.011 | 0.01 | 0.035 |
| E7 | 2.46 | 0.56 | 0.56 | 4.04 | 9.06 | 10.11 | 4.47 | 2.50 | 14.69 | — | — | 0.01 | 0.013 | 0.008 | 0.017 |
| A1a | 2.66 | 0.56 | 0.56 | 4.04 | 9.06 | 10.11 | 4.47 | 2.50 | 14.69 | — | — | 0.01 | 0.013 | 0.008 | 0.017 |
| A1b | 2.96 | 0.56 | 0.56 | 4.04 | 9.06 | 10.11 | 4.47 | 2.50 | 14.69 | — | — | 0.01 | 0.013 | 0.008 | 0.017 |
| A1c | 3.02 | 0.44 | 0.44 | 4.41 | 10.99 | 10.2 | 5.22 | 3.08 | 14.96 | — | — | 0.016 | 0.014 | 0.01 | 0.021 |
| A1d | 3.27 | 0.44 | 0.44 | 4.41 | 10.99 | 10.2 | 5.22 | 3.08 | 14.96 | — | — | 0.016 | 0.014 | 0.01 | 0.021 |
| A2a | 2.44 | 0.58 | 0.54 | 3.90 | 10.05 | 7.59 | 5.31 | — | 13.97 | — | — | 0.01 | 0.011 | 0.009 | 0.017 |
| A2b | 2.59 | 0.58 | 0.54 | 3.90 | 10.05 | 7.59 | 5.31 | — | 13.97 | — | — | 0.01 | 0.011 | 0.009 | 0.017 |
| A2c | 2.74 | 0.58 | 0.54 | 3.90 | 10.05 | 7.59 | 5.31 | — | 13.97 | — | — | 0.01 | 0.011 | 0.009 | 0.017 |
| A2d | 2.82 | 0.43 | 0.42 | 3.98 | 10.43 | 7.44 | 6.35 | — | 14.15 | — | — | 0.008 | 0.012 | 0.011 | 0.024 |
| A2e | 3.07 | 0.43 | 0.42 | 3.98 | 10.43 | 7.44 | 6.35 | — | 14.15 | — | — | 0.008 | 0.012 | 0.011 | 0.024 |
| A3a | 3.37 | 0.47 | 0.35 | 3.94 | 10.19 | 5.2 | 9.12 | — | 9.17 | — | — | 0.01 | 0.005 | 0.011 | 0.039 |
| A3b | 3.47 | 0.47 | 0.35 | 3.94 | 10.19 | 5.2 | 9.12 | — | 9.17 | — | — | 0.01 | 0.005 | 0.011 | 0.039 |
| A3c | 3.57 | 0.47 | 0.35 | 3.94 | 10.19 | 5.2 | 9.12 | — | 9.17 | — | — | 0.01 | 0.005 | 0.011 | 0.039 |

The articles for testing, the compositions of which are set forth in Table 1, were produced by conventional powder metallurgy practices including the production of prealloyed powder by nitrogen gas atomization followed by consolidation to full density by hot isostatic compacting.

The samples of Table 1 were austenitized, quenched in oil, and tempered four times, each time for two hours, at the temperatures shown in Table 2. They were then tested to measure hardness after tempering at these temperatures. Wear resistance was determined, as reported in Table 3, by pin abrasion testing and cross-cylinder testing. Bend fracture strength and Charpy C-notch impact toughness were determined on longitudinal and transverse specimens after heat treatment using the hardening and tempering temperatures given in Table 3.

TABLE 2

Tempering Response Potential Alloys for Ultra High Hardness Application

| | | Tempering Response* - Hardness Rc | | | | | | |
|---|---|---|---|---|---|---|---|---|
| Alloy | Aust. T. ° F. | 950° F. | 1000° F. | 1025° F. | 1050° F. | 1100° F. | 1150° F. | 1200° F. |
| Rex 76 | 2200 | 66.9 | 68.9 | — | 66.5 | 65.9 | — | 57.0 |
| Rex 25 | 2250 | 67.8 | 67.8 | — | 66.1 | 64.4 | — | 55.7 |
| M25a | 2225 | 68.4 | 68.5 | — | 66.7 | 65.2 | — | 56.6 |
| M25b | 2225 | 67.4 | 68.4 | — | 67.8 | 65.7 | — | 57.2 |
| M2511a | 2250 | 69.1 | 68.8 | 68.1 | — | — | 63.2 | — |
| M2511b | 2250 | 66.7 | 69.2 | 69.7 | — | — | 66.4 | — |
| M2511c | 2225 | 65.7 | 68.6 | 69.2 | — | — | 66.6 | — |
| M2511d | 2225 | 64.2 | 67.5 | 68.7 | — | — | 65.3 | — |
| M766a | 2200 | 70.0 | 70.2 | — | 68.7 | 66.8 | — | 57.1 |
| M766b | 2200 | 69.7 | 70.1 | — | 69.2 | 67.5 | — | 58.2 |
| M766c | 2175 | 69.3 | 69.8 | — | — | — | — | — |
| M769a | 2200 | 70.2 | 69.8 | — | 67.9 | 66.4 | — | 56.2 |
| M769b | 2175 | 70.2 | 70.0 | — | — | — | — | — |
| E1a | 2200 | 69.3 | 68.2 | — | 67.2 | 62.2 | — | 52.4 |
| E1b | 2200 | 69.3 | 69.4 | — | 67.4 | 62.9 | — | 55.8 |
| E2b | 2200 | 70.4 | 69.8 | — | 68.1 | 63.9 | — | 55.6 |
| E3a | 2200 | 68.9 | 67.5 | — | 65.4 | 61.4 | — | 53.9 |

TABLE 2-continued

Tempering Response Potential Alloys for Ultra High Hardness Application

| Alloy | Aust. T. ° F. | Tempering Response* - Hardness Rc 950° F. | 1000° F. | 1025° F. | 1050° F. | 1100° F. | 1150° F. | 1200° F. |
|---|---|---|---|---|---|---|---|---|
| E3b | 2200 | 69.2 | 68.2 | — | 66.4 | 64.9 | — | 53.9 |
| E4a | 2200 | 69.1 | 68.9 | — | 67.6 | 62.2 | — | 54.9 |
| E4b | 2200 | 69.0 | 69.9 | — | 67.2 | 63.9 | — | 55.0 |
| E6a | 2225 | 70.1 | 68.9 | — | 67.8 | 66.1 | — | 60.6 |
| E6b | 2225 | 71.7 | 70.7 | — | 69.5 | 67.1 | — | 59.3 |
| E7 | 2225 | 72.2 | 70.3 | — | 70.4 | 67.6 | — | 57.5 |
| A1a | 2240 | 71.7 | 72.3 | — | 70.8 | 68.9 | — | 62.5 |
| A1b | 2225 | 68.9 | 71.3 | — | 71.1 | 70.0 | — | 63.8 |
| A1c | 2200 | 70.3 | 72.6 | — | 72.2 | 70.9 | — | 63.1 |
| A1d | 2200 | 70 | 72.3 | — | 72.6 | 70.9 | — | 63.8 |
| A2a | 2225 | 71.8 | 71.0 | — | 70.8 | 68.5 | — | 60.9 |
| A2b | 2200 | 69.5 | 71.4 | — | 71.0 | 68.8 | — | 60.3 |
| A2c | 2200 | 67.5 | 70.9 | — | 70.6 | 68.8 | — | 60.3 |
| A2d | 2200 | 69.2 | 71.6 | — | 70.8 | 69.9 | — | 62.3 |
| A2e | 2200 | 69.4 | 71.4 | — | 71.4 | 69.3 | — | 62.6 |
| A3a | 2240 | 67.7 | 71.2 | — | 69.6 | 68.5 | — | 62.5 |
| A3b | 2240 | 66.2 | 69.2 | — | 70.2 | 68.9 | — | 62.5 |
| A3c | 2240 | 68.7 | 70.2 | — | 70.0 | 68.1 | — | 62.6 |

*Hardness after tempering 4 × 2 hours at the given temperature.

TABLE 3

Charpy C-Notch Impact Energy, Bend Fracture Strength and Wear Resistance of Selected Alloys for Ultra High Hardness Application

| Alloy | Heat Treat. Aust./Temp. (° F./° F.) | C-Notch Energy (ft. lbs.) Long. | Trans. | BFS (ksi) Long. | Trans. | Pin Abrasion (mg) | Cr. Cyl. $10^{10}$ psi |
|---|---|---|---|---|---|---|---|
| REX 76 | 2175/1025 | 11 | 6.5 | 576 | 390 | 38.3 | 42 |
| REX 25 | 2250/1025 | 9.5 | | 531 | | | |
| E6a | 2250/1025 | 4.7 | 3.7 | 360 | 300 | | |
| E6b | 2240/1025 | 2.7 | 2.2 | 253 | 228 | 9.3 | 104 |
| E7 | 2225/1025 | 3.8 | 3.5 | 321 | 154 | 15 | 71 |
| A1c | 2200/1025 | 1.7 | 1.6 | 196 | 158.0 | 2.2 | 73 |
| A2a | 2200/1025 | 2.6 | 2.6 | 294 | 218 | 4.9 | 77 |
| A2d | 2200/1025 | 2.0 | 1.7 | 219 | 163 | 2.9 | 81 |
| A3a | 2225/1025 | 3.8 | 3.3 | 292 | 231 | 2.1 | 102 |

Alloys A1a through A1d, A2a through A2e, and A3a through A3c are alloy compositions in accordance with the invention. As may be seen from the tempering response data set forth in Table 2 and graphically presented in FIG. 1, alloys of the series A1, A2, and A3 in accordance with the invention exhibited superior hardness at tempering temperatures up to 1200° F. relative to the existing commercial alloys. Likewise, as shown in Table 3, samples A1c, A2a, A2d, and A3a in accordance with the invention also exhibited excellent wear resistance as determined by the pin abrasion and cross-cylinder test results. Of these invention alloys, alloys A1 exhibited optimum combination of the tempering response and wear resistance. Alloys A2 exhibited slightly lower hardness after tempering at 1200° F., but somewhat improved toughness and bend fracture strength than alloys A1. All of the invention alloys, however, as shown in Table 3 and FIG. 1, exhibited improved combinations of tempering response, toughness and wear resistance over the existing commercial alloys.

TABLE 4

Hot Hardness (HRC) of CPM Rex 76 and New Alloys

| Alloy | Test Temperature (° F.) 75 | 950 | 1000 | 1050 | 1100 | 1150 | 1200 | 1300 |
|---|---|---|---|---|---|---|---|---|
| REX 76 | 67.5 | 60 | 59.5 | 59 | 58 | 52.5 | 46.5 | — |
| A1c | 73.5 | — | 64.5 | — | 63 | — | 57.5 | 39 |
| A2d | 72 | — | 63 | — | 60 | — | 56 | 38.5 |
| A2e | 72 | — | 62.5 | — | 60 | — | 56 | 39 |
| A3a | 71.5 | — | 61 | — | 58.5 | — | 53 | 33.5 |

Table 4 and FIG. 2 indicate the hot hardness values for alloys A1c, A2d, A2c, and A3a, in accordance with the invention, compared to the existing commercial alloy (REX 76). As may be seen from this data, all of the alloys in accordance with the invention exhibited improved hot hardness at elevated temperatures up to 1300° F., compared to the existing commercial alloy.

All compositions set forth in the specification are in weight percent, unless otherwise indicated.

What is claimed is:

1. A powder metallurgy produced high-speed steel article of compacted high speed steel prealloyed powder particles having an improved combination of wear resistance and toughness, consisting essentially of, in weight percent, 2.4 to 3.9 carbon, up to 0.8 manganese, up to 0.8 silicon, 3.75 to 4.75 chromium, 9.0 to 11.5 tungsten, 4.75 to 10.75 molybdenum, 4.0 to 10.0 vanadium, and 8.5 to 16.0 cobalt, with 2.0 to 4.0 niobium being optionally present, and balance iron and incidental impurities.

2. The article of claim 1 having 2.6 to 3.5 carbon, 3.75 to 4.75 chromium, 9.0 to 11.5 tungsten, 9.5 to 10.75 molybdenum, 4.0 to 6.0 vanadium, 2 to 4 niobium and 14.0 to 16.0 cobalt.

3. The article of claim 2 having 3.0 to 3.3 carbon, 0.5 maximum manganese, 0.5 maximum silicon, 4.2 to 4.6 chromium, 10.5 to 11.0 tungsten, 10.0 to 10.5 molybdenum, 5.0 to 5.5 vanadium, 2.8 to 3.2 niobium, and 14.5 to 15.0 cobalt.

4. The article of claim 1 having 2.4 to 3.2 carbon, 3.75 to 4.5 chromium, 9.75 to 10.75 tungsten, 6.75 to 8.25 molybdenum, 5.0 to 7.0 vanadium, and 13.0 to 15.0 cobalt.

5. The article of claim 4, having 2.9 to 3.10 carbon, 0.5 maximum manganese, 0.5 maximum silicon, 3.9 to 4.2 chromium, 10.0 to 10.5 tungsten, 7.25 to 7.75 molybdenum, 6.0 to 6.5 vanadium, and 14.0 to 14.5 cobalt.

6. The article of claim 1, having 2.9 to 3.9 carbon, 3.75 to 4.5 chromium, 9.5 to 11.0 tungsten, 4.75 to 6.0 molybdenum, 8.5 to 10.0 vanadium, and 8.5 to 10.0 cobalt.

7. The article of claim 6, having 3.2 to 3.6 carbon, 0.5 maximum manganese, 0.5 maximum silicon, 3.9 to 4.2 chromium, 10.0 to 10.5 tungsten, 5 to 5.5 molybdenum, 9.0 to 9.5 vanadium and 9.0 to 9.5 cobalt.

8. The article of claims 1, 2, 3, 4, 5, 6, or 7, having a minimum hardness of 70 $R_c$ in the as-quenched and tempered condition.

9. The article of claims 1, 2, 3, 4, 5, 6, or 7, having a minimum hardness of 61 $R_c$ in the as-quenched and tempered condition when tempered at at 1200° F.

10. The article of claim 8, wherein said minimum hardness is 72 $R_c$.

11. The article of claim 9, wherein said minimum hardness when tempered at 1200° F. is 63 $R_c$.

12. The article of claim 8 being a gear cutting tool.

13. The article of claim 9 being a gear cutting tool.

14. The article of claim 8 being a surface coating on a substrate.

15. The article of claim 9 being a surface coating on a substrate.

* * * * *

UNITED STATES PATENT AND TRADEMARK OFFICE

CERTIFICATE OF CORRECTION

PATENT NO.: 6,057,045

DATED: May 2, 2000

INVENTOR(S): Andrzej L. WOJCIESZYNSKI and William STASKO

It is certified that an error appears in the above-identified patent and that said Letters Patent is hereby corrected as shown below:

IN THE TITLE:

Title page, item [54], insert --HIGH HARDNESS POWDER METALLURGY- before "HIGH-SPEED STEEL ARTICLE".

Signed and Sealed this

Sixth Day of March, 2001

Nicholas P. Godici

*Attest:*

NICHOLAS P. GODICI

*Attesting Officer*

*Acting Director of the United States Patent and Trademark Office*